US008554100B2

(12) United States Patent
Ichinose et al.

(10) Patent No.: US 8,554,100 B2
(45) Date of Patent: Oct. 8, 2013

(54) IMAGE FORMING APPARATUS USING AN ELECTROPHOTOGRAPHIC SYSTEM

(75) Inventors: Kimitaka Ichinose, Mishima (JP); Takao Kume, Yokohama (JP); Hiroyuki Kadowaki, Mishima (JP); Tomoaki Nakai, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 300 days.

(21) Appl. No.: 13/075,754

(22) Filed: Mar. 30, 2011

(65) Prior Publication Data

US 2011/0243599 A1 Oct. 6, 2011

(30) Foreign Application Priority Data

Mar. 31, 2010 (JP) ..... 2010-083462

(51) Int. Cl.
*G03G 15/01* (2006.01)
*G03G 15/16* (2006.01)
*G03G 21/00* (2006.01)

(52) U.S. Cl.
USPC ..... 399/71; 399/101

(58) Field of Classification Search
USPC ..... 399/71, 101, 149, 334
See application file for complete search history.

(56) References Cited

U.S. PATENT DOCUMENTS

| | | | | |
|---|---|---|---|---|
| 7,474,865 | B2 * | 1/2009 | Chiba et al. | 399/101 |
| 8,290,385 | B2 * | 10/2012 | Nakagawa et al. | 399/101 X |
| 2011/0076041 | A1 * | 3/2011 | Hyakutake et al. | 399/101 X |
| 2011/0091234 | A1 * | 4/2011 | Fukuyama et al. | 399/71 |

FOREIGN PATENT DOCUMENTS

| | | | |
|---|---|---|---|
| JP | 2000-098694 | A | 4/2000 |
| JP | 2001-324855 | A | 11/2001 |
| JP | 2004-279474 | A | 10/2004 |

* cited by examiner

*Primary Examiner* — Sophia S Chen
(74) *Attorney, Agent, or Firm* — Canon USA Inc. IP Division

(57) ABSTRACT

An image forming apparatus including, a plurality of image bearing members, a plurality of developing units which includes toner storage containers and a belt transferring toner images onto a transfer material, the image forming apparatus being capable of executing a first cleaning mode and a second cleaning mode to move the toner adhering onto the belt onto the image bearing members and to collect the adhering toner into the toner storage containers, wherein, in the first cleaning mode, the adhering toner is collected into the toner storage container of the developing unit developing a black toner, and in the second cleaning mode, a portion of the adhering toner is collected into the toner storage container corresponding to the image bearing member located at a most upstream position and a rest of the adhering toner is collected into the toner storage container of the developing unit developing the black toner.

9 Claims, 4 Drawing Sheets

IMAGE FORMING APPARATUS USING AN ELECTROPHOTOGRAPHIC SYSTEM

BACKGROUND OF THE INVENTION

1. Field of the Invention

The present invention relates to a color image forming apparatus using an electrophotographic system, such as a laser printer, a copier, or a facsimile.

2. Description of the Related Art

Conventionally, there has been known a configuration of an electrophotographic image forming apparatus including collecting means and a collecting container for collecting an adhering toner that is not transferred onto a transfer material and remaining on an image bearing member (photosensitive drum or intermediate transfer member).

A color image forming apparatus generally uses four colors of toner: Y (yellow), M (magenta), C (cyan), and K (black). For respective color toners, corresponding developing devices (developing roller and developing storage container) are provided. Further, in order to dispense with the collecting container for the photosensitive drum, there has conventionally known a method collecting the adhering toner into the developing device and reusing the collected toner in image formation. However, in the color image forming apparatus, since the respective color toners are superposed one another when forming a color image, there are cases where plurality of color toners are mixed to be adhered on the photosensitive drum. There is a problem in that when those mixed color toners are recollected into the developing storage container of a particular developing device, there causes color mixture within the developing container, which leads to a variation in color tone when an image forming operation is performed to form an image. In particular, when the black color is mixed with yellow, cyan, and magenta colors, respectively, large variation in color tone occurs.

In order to solve this problem, Japanese Patent Application Laid-Open No. 2004-279474 discloses a system in which a mixed-color toner on a transfer member is recollected into a developing storage container of a black developing device. This is based on such characteristics that a black color appears when yellow, cyan, and magenta colors are mixed.

Further, Japanese Patent Application Laid-Open No. 2001-324855 discloses a system in which a patch toner of a single-color toner formed on a transfer member is recollected into a developing storage container of developing device for respective colors.

However, for example, when such a jamming occurs that the transfer material conveyed within the image forming apparatus is stopped in the midway, or when a misprinting occurs, a large amount of toner adheres onto an intermediate transfer belt and a conveying belt.

Note that, the term "jamming" refers to a state in which the image forming operation is aborted due to a conveying failure of the transfer material from a cassette to a fixing device. The term "misprinting" refers to a state in which the image formation is stopped, leaving a toner adhering onto the intermediate transfer belt, due to unmatching between an image size formed on the intermediate transfer belt and a transfer material size, deviation of an image formation timing and conveyance timing of the transfer material, and the like.

A color ratio of those adhering toners is determined depending on a print at the time of printing, and hence it is not able to specify the color ratio. In such state, when the entire toners are recollected into a developing storage container of a black developing device, there is a high possibility of causing a variation in black color tone at the time of image formation.

Further, unlike the patch toner, the toners which have adhered onto the belt due to the jamming, the misprinting, and the like are not formed of a single-color toner. Therefore, it is impossible to recollect the toners into the developing storage container of the developing device for respective colors.

SUMMARY OF THE INVENTION

The present invention provides a color image forming apparatus in which, even when an adhering toner exists on a belt in a large amount, the adhering toner is recollected into a developing storage container of a developing device so that a variation in color tone due to a color mixture of toner may be suppressed as much as possible.

An image forming apparatus of the present invention includes: a plurality of image bearing members on which an electrostatic latent image is formed; a plurality of developing units which includes toner storage containers respectively containing a different color of toner, and which respectively develops the toner contained in the toner storage container onto each of the plurality of image bearing members; and a belt which is capable of rotating, and which transfers toner images developed on the plurality of image bearing members onto a transfer material, the image forming apparatus being capable of executing a first cleaning mode and a second cleaning mode to move the toner adhering onto the belt from the belt onto the image bearing members and to collect the adhering toner moved onto the image bearing members into the toner storage containers of the developing units, wherein, in the first cleaning mode, the adhering toner is moved onto the image bearing member corresponding to the developing unit developing a black toner and the moved adhering toner is collected into the toner storage container of the developing unit developing the black toner, and in the second cleaning mode, a portion of the adhering toner is moved to the image bearing member that corresponds to the developing unit developing a toner other than the black toner and is located at a most upstream position in a rotation direction of the belt among the plurality of image bearing members, the portion of the adhering toner is collected into the toner storage container of the development unit corresponding to the image bearing member located at the most upstream position, and the rest of the adhering toner is moved to the image bearing member corresponding to the developing unit developing the black toner to collect the rest of the adhering toner into the toner storage container of the developing unit developing the black toner.

Further features of the present invention will become apparent from the following description of exemplary embodiments with reference to the attached drawings.

DESCRIPTION OF THE EMBODIMENTS

Hereinafter, a color image forming apparatus according to the present invention is described in greater detail with reference to the drawings.

First Embodiment

Figure 1:
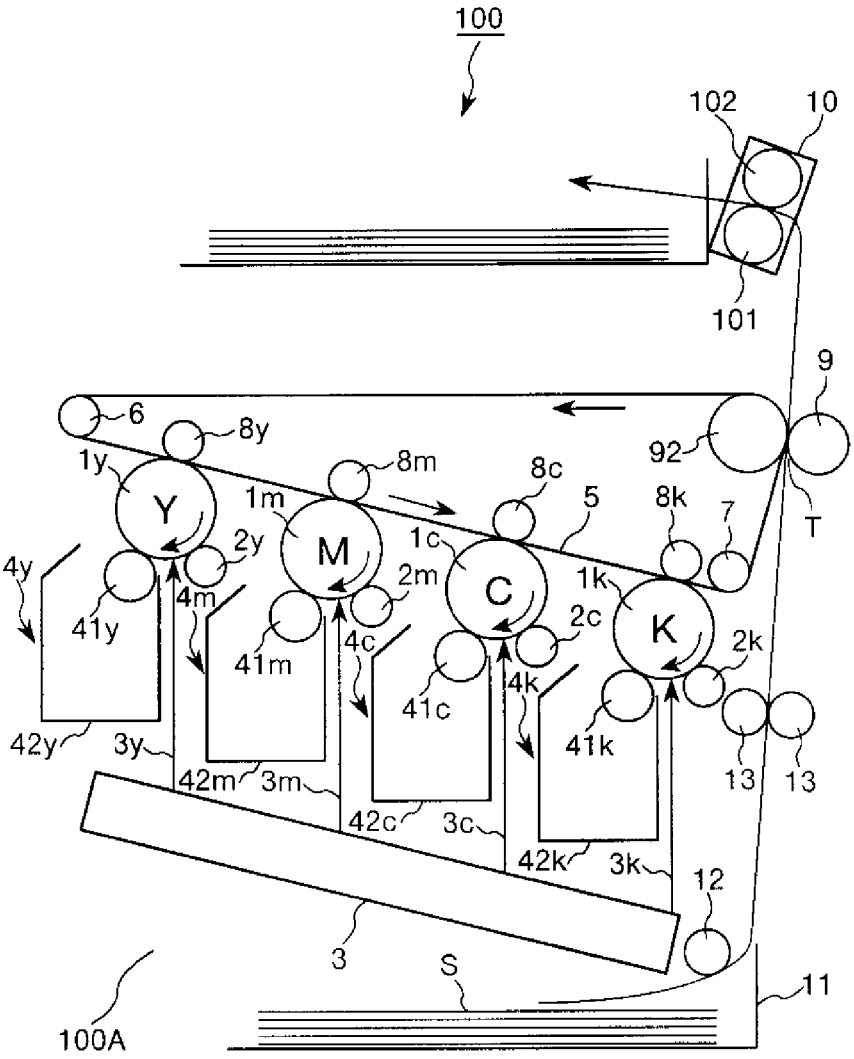
FIG. 1 is a longitudinal sectional view illustrating a general configuration of an embodiment of a color image forming apparatus according to the present invention.

FIG. 1 is a longitudinal sectional view illustrating a general schematic configuration of an embodiment of the color image forming apparatus according to the present invention, which is a four-color inline type full color printer for an intermediate transfer system.

[General Configuration of Image Forming Apparatus]

With reference to FIG. 1, the general configuration of the color image forming apparatus according to this embodiment is described. The color image forming apparatus 100 illustrated in FIG. 1 includes substantially horizontally juxtaposed multiple, in this embodiment four, image forming stations Y, M, C, K. The image forming stations Y, M, C, K include respective drum-like photosensitive members (hereinafter referred to as "photosensitive drum") 1 as an image bearing member, that is, a yellow photosensitive drum 1*y* as a first image bearing member, a magenta photosensitive drum 1*m* as a second image bearing member, a cyan photosensitive drum 1*c* as a third image bearing member, and a black photosensitive drum 1*k* as a fourth image bearing member, respectively. Those photosensitive drums 1 are driven to rotate in an arrow direction by a drive unit (not shown). Around the respective photosensitive drums 1, charging units 2 (2*y*, 2*m*, 2*c*, 2*k*) for uniformly charging a surface of the photosensitive drums 1 in order in a rotation direction is provided, and an exposing unit 3 for irradiating the photosensitive drums 1 with light to form electrostatic latent images is provided. In this embodiment, an exposure scanner for emitting laser beams (3*y*, 3*m*, 3*c*, 3*k*) is provided as the exposing unit. Further, developing units 4 (4*y*, 4*m*, 4*c*, 4*k*) are arranged to cause a toner to adhere to the electrostatic latent image on the photosensitive drum 1 so as to develop a toner image. The developing units 4 each include respective developing rollers 41 (41*y*, 41*m*, 41*c*, 41*k*) as a developer carrier and respective toner storage containers 42 (42*y*, 42*m*, 42*c*, 42*k*) which contain the toner for supplying to the developing rollers 41.

Around the photosensitive drums 1, an intermediate transfer belt 5 is arranged as an intermediate transfer member which rotates while being in contact with the photosensitive drums 1. Further, opposed to the photosensitive drums 1, primary transfer rollers 8 (8*y*, 8*m*, 8*c*, 8*k*) are arranged as a primary transfer member for transferring the toner image on the photosensitive drums 1 to the intermediate transfer belt 5. The toner image on the intermediate transfer belt 5 is transferred onto a transfer material S by a secondary transfer roller 9 as a secondary transfer member.

In this embodiment, the image forming apparatus 100 includes four developing units, that is, the developing unit 4*y*, the developing unit 4*m*, the developing unit 4*c* and the developing unit 4*k*, each including the respective developing roller 41 and toner storage container 42.

The photosensitive drum 1, the charging unit 2, and the developing unit 4 of this embodiment are integrated as a cartridge to form a process cartridge and attachable/detachable with respect to the color image forming apparatus.

Next, the configuration of each part is described successively.

The photosensitive drum 1 is constructed by applying an organic photoconductor layer (OPC photoreceptor) on a peripheral surface of an aluminum cylinder, for example, having a diameter of 30 mm. The photosensitive drum 1 is rotatably supported by a support member (not shown) on its both ends, and a drive force from a drive motor (not shown) is transferred onto one end so as to drive the photosensitive drums 1 to rotate.

Each of the charging units 2 is a contact type in this embodiment, and includes respective roller-like conductive rollers 2*y*, 2*m*, 2*c*, 2*k*. The charging units 2 bring the rollers into contact with the surface of the photosensitive drums 1, and uniformly charge the photosensitive drums 1 to the negative polarity by applying to the rollers a predetermined charging voltage, which has a negative polarity and is equal to or higher than a discharge starting voltage, by an electric source (not shown).

The exposing unit 3 is a laser optical unit, in which the laser beams 3*y*, 3*m*, 3*c*, 3*k* are controlled to be emitted in response to an image signal by a drive circuit (not shown), thereby selectively exposing the surface of the charged photosensitive drum 1 to form the electrostatic latent image.

Four developing units 4 include the toner storage containers 42 and the developing rollers 41. The toner storage container 42 respectively contain a yellow toner, a magenta toner, a cyan toner, and a black toner, in order from an upstream side in the rotation direction of the intermediate transfer belt 5 (left side of FIG. 1). The toner is conveyed from the toner storage container 42 to the developing roller 41. The toner adhering onto the developing roller 41 is charged to a uniform polarity (in this case the negative polarity) by sliding contact. In this state, a developing voltage, which has an absolute value lower than a surface potential of the photosensitive drums 1 and has the negative polarity, is applied to the developing rollers 41. As a result, it is possible to cause the toner to adhere only to the electrostatic latent image, thereby developing an image as the toner image.

The primary transfer rollers 8 are conductive rollers 8*y*, 8*m*, 8*c*, 8*k* formed in a roller shape. For example, a shaft having an outer diameter of 6 mm made of metal such as SUS is covered so as to form a foamed elastic roller having an outer diameter of 12 mm. The foamed elastic roller has a resistance of $10^6$ to $10^9\Omega$. The primary transfer rollers 8 are pressed against the photosensitive drums 1 with the intermediate transfer belt 5 interposed therebetween, and applied a primary transfer voltage of a positive polarity by the electric source (not shown). As a result, the toner image on the photosensitive drums 1 is transferred onto the intermediate transfer belt 5.

The intermediate transfer belt 5 is formed of an endless film-like member having a thickness of approximately 50 to 150 μm and a specific volume resistivity of $10^{7\,t}$ to $10^{14}$ Ωcm. The volume resistivity is a value obtained by using a measuring probe conforming to JIS K6911 and a high resistance meter R2340 manufactured by ADVANTEST Corp., at a temperature of 25° C., a relative humidity of 50%, and applying 50 to 100 V.

The intermediate transfer belt 5 is looped around a drive roller 92 for rotating the intermediate transfer belt 5 and driven rollers 6, 7 for applying an appropriate tension, and turned in an arrow direction. The drive roller 92 and the driven rollers 6, 7 are tension members.

The secondary transfer roller 9 has the same configuration and physical properties as the primary transfer rollers 8. The secondary transfer roller 9 is pressed against the intermediate transfer belt 5 with the transfer material S interposed therebetween, and applied a secondary transfer voltage of the positive polarity by the electric source (not shown), thereby causing the toner image on the intermediate transfer belt 5 to be transferred onto the transfer material S. In order to form an image by using the image forming apparatus 100, the transfer material S, which is stored in a cassette 11 installed in a lower part of the apparatus main body 100A, is fed by a feed roller 12 one by one. The transfer material S is conveyed to a secondary transfer part T by a pair of conveying rollers 13. The toner image formed of yellow, magenta, cyan, and black toners on the intermediate transfer belt 5 is secondarily transferred onto the transfer material S, thereby forming a color image. The transfer material S is passed through the fixing device 10 including a pair of rollers including a heating roller 101 and a pressure roller 102 so as to thermally fixing the toner image, and discharged to an upper part of the apparatus.

In the image forming apparatus 100 illustrated in this embodiment, the primary transfer and the secondary transfer achieves almost 100% transfer efficiency. Therefore, in the course of the above-mentioned image forming operation, there is no visible toner on the photosensitive drums 1 or the intermediate transfer belt 5. Thus, in this embodiment, there is no collecting container disposed solely for collecting an adhering toner on the photosensitive drums 1 or the intermediate transfer belt 5.

However, depending on temperature and humidity of an ambient environment of the apparatus, or the kind of the transfer material S, the transfer efficiency does not reach 100%, and the toner may slightly remain under a state of adhering onto the photosensitive drums 1 or the intermediate transfer belt 5. For example, in a low-temperature and low-humidity environment, there may be a case where the resistance of the intermediate transfer belt 5, the primary transfer rollers 8, and the secondary transfer roller 9 increases and an electric field required for the primary transfer and the secondary transfer is not generated. Further, in the case of the transfer material S having a surface with significant unevenness, an intensity of a transfer electric field may vary in concave portions and convex portions, thereby partly reducing the transfer efficiency.

When the image forming apparatus is continuously used under such a state, the adhering toner on the intermediate transfer belt 5 may eventually adhere to the transfer material S to become an obvious toner soil. In order to prevent this, in this embodiment, a first cleaning mode as follows is periodically performed. The first cleaning mode is a normal cleaning mode.

Figure 2:
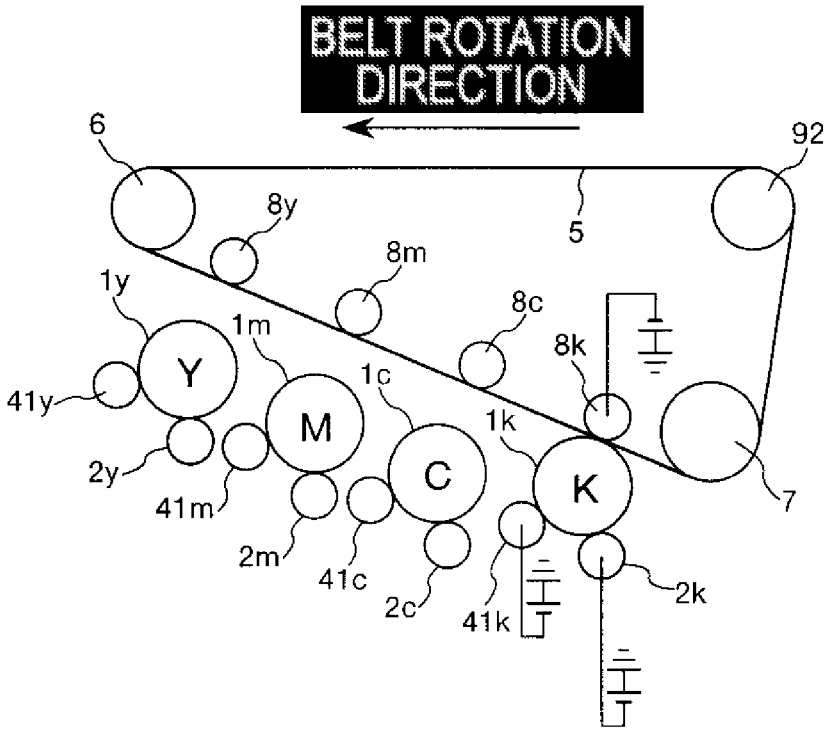
FIG. 2 illustrates a first cleaning mode of the color image forming apparatus.

(1) The photosensitive drums 1*y*, 1*m*, and 1*c* for yellow (Y), magenta (M), and cyan (C) are separated from the intermediate transfer belt 5. FIG. 2 illustrates the separated state. The separation may be performed in such a manner that the photosensitive drums 1*y*, 1*m*, and 1*c* are retracted from the intermediate transfer belt 5. Further, the primary transfer rollers 8 opposed to each of the photosensitive drums 1*y*, 1*m*, and 1*c* with the intermediate transfer belt 5 interposed therebetween may be configured to retract from the photosensitive drums 1*y*, 1*m*, and 1*c*.

(2) A negative polarity voltage is applied to the black (K) primary transfer roller 8*k*.

(3) The negative polarity voltage, which is equal to or higher than the discharge starting voltage, is applied to the black charging unit 2*k*.

(4) A voltage, which has an absolute value lower than the surface potential of the black photosensitive drum 1*k* and has the negative polarity, is applied to the black developing roller 41*k*.

The operation (1) is aimed to avoid shifting a negative polarity toner adhering onto the intermediate transfer belt 5 to the photosensitive drums 1*y*, 1*m*, and 1*c* for yellow, magenta, and cyan. Any method other than the one described above may be used as long as this aim may be achieved. For example, the following method may be used: the photosensitive drums 1*y*, 1*m*, and 1*c* for yellow, magenta, and cyan are kept in contact with the intermediate transfer belt 5, while a positive polarity voltage is applied to the primary transfer rollers 8*y*, 8*m*, and 8*c* for yellow, magenta, and cyan.

The operation (2) is aimed to shift the negative polarity toner adhering onto the intermediate transfer belt 5 to the photosensitive drum 1*k*.

The operation (3) is aimed to uniformly charge the surface of the photosensitive drum 1*k* to the negative polarity and charge the toner adhering onto the photosensitive drum 1*k* to the negative polarity. In order to more uniformly charge the toner, an AC voltage having a negative polarity DC voltage superimposed thereon may be applied to the charging unit 2*k*. In this case, amplitude of the AC voltage is set to be equal to or higher than the discharge starting voltage.

The operation (4) is aimed to shift the negative polarity toner adhering onto the photosensitive drum 1*k* to the developing roller 41*k*, and finally collect the toner into the toner storage container 42*k* as a black toner collecting container. Collected toner is reused in and after the next image formation.

Those operations are continuously performed for at least ⅕ round of the intermediate transfer belt 5. In this way, the negative polarity toner adhering onto the intermediate transfer belt 5 may be entirely collected into the toner storage container 42*k* as the black toner storage container. In order to facilitate the toner shift from the intermediate transfer belt 5 to the photosensitive drum 1*k*, and then from the photosensitive drum 1*k* to the developing roller 41*k*, an appropriate circumferential speed difference may be set between the intermediate transfer belt 5 and the photosensitive drum 1*k* and between the photosensitive drum 1*k* and the developing roller 41*k* to move (turn) the intermediate transfer belt 5.

Further, after the above-mentioned series of operations, in order to collect the positive polarity toner on the intermediate transfer belt 5 into the toner storage container 42*k*, the voltage applied to the black primary transfer roller 8*k* may be switched to the positive polarity, and the series of operations may be continued for more than ⅕ round of the intermediate transfer belt 5.

By periodically performing the first cleaning mode, the toner adhering onto the intermediate transfer belt 5 may be recollected into the black toner storage container 42*k*. Thus, it is possible to prevent an image from obviously being soiled by the toner. Further, by performing those operations, it is possible to collect the mixed-color toner by only the black toner storage container 42*k*. Thus, it is possible to prevent a variation in color tone when the toner is reused.

Next, a second cleaning mode, which is carried out when a large amount of toner adheres onto the photosensitive drums 1 or the intermediate transfer belt 5 due to a jamming, a misprinting, and the like, is described with reference to FIGS. 3A to 3F and FIG. 4.

The operation for cleaning the toner adhering onto the belt in the case of the jamming and the misprinting is described below.

Figure 3A:
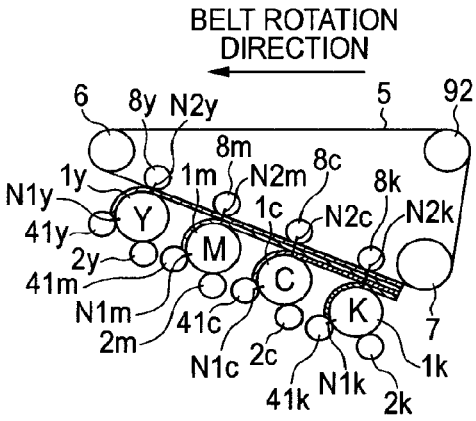
FIGS. 3A, 3B, 3C, 3D, 3E and 3F illustrate a second cleaning mode operation of the color image forming apparatus.

FIG. 3A illustrates a state immediately after a jam processing and the misprinting. In this state, all the photosensitive drums 1 are separated from the intermediate transfer belt 5, and the photosensitive drums 1 and the intermediate transfer belt 5 are turned respectively (FIG. 3B).

Figure 3B:
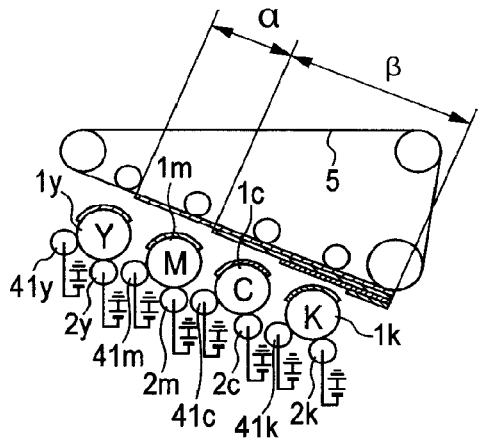

As illustrated in FIG. 3B, first of all, the separating operation of all the photosensitive drums 1 and the intermediate transfer belt 5 is performed. The reason for this operation is to ensure that a single-color residual toner, which has been developed but not been transferred, is conveyed to the developing roller 41. To be precise, the reason is to avoid shifting the single-color residual toner existing in a region from a contact position (nip position) N1 (N1*y*, N1*m*, N1*c*, N1*k*) between the photosensitive drums 1 and the developing roller 41 to the nip position N2 (N2*y*, N2*m*, N2*c*, N2*k*) between the photosensitive drums 1 and the intermediate transfer roller 8 to the intermediate transfer belt 5. At the same time, the reason is to avoid shifting different single-color toner or mixed-color toners existing on the intermediate transfer belt 5 to the photosensitive drums 1.

As illustrated in FIG. 3B, when turning or moving the photosensitive drums 1 and the intermediate transfer belt 5, the negative polarity voltage equal to or higher than the discharge starting voltage is applied to each of the charging units 2. As with the operation (3) in the first cleaning mode, the AC voltage having the negative polarity DC voltage superimposed thereon (which has the amplitude equal to or higher than the discharge starting voltage) may be applied. This is intended to obtain the same effect as that of the first cleaning mode, that is, an effect of uniformly charging the surface of the photosensitive drums 1 to the negative polarity and charging the toner adhering onto the photosensitive drums 1 to the negative polarity.

Further, as with the operation (4) in the first cleaning mode, the negative polarity voltage, which has an absolute value lower than the surface potential of the photosensitive drums 1, is applied to the developing rollers 41. This is intended to obtain an effect of shifting the negative polarity toner adhering onto each of the photosensitive drums 1 to their respective development rollers 41, and finally collecting the toner into the toner storage containers 42.

Figure 3C:
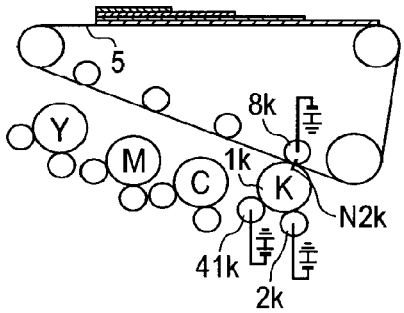

Subsequently, as illustrated in FIG. 3C, the black photosensitive drum 1*k* and the intermediate transfer belt 5 are brought into contact before a leading end of the mixed-color toner transferred onto the intermediate transfer belt 5 reaches the black primary transfer nip position N2*k*. Then, as with the operation (2) in the first cleaning mode, the negative polarity voltage is applied to the black primary transfer roller 8*k*. This is intended to obtain an effect of shifting the negative polarity toner adhering onto the intermediate transfer belt 5 to the black photosensitive drum 1*k*. In order to finally recollect the toner shifted to the photosensitive drum 1*k* by the black toner storage container 42*k*, the voltage applied in FIG. 3B is continuously applied to the black charging unit 2*k* and the black developing roller 41*k*.

With the above-mentioned operations, the mixed-color toner (negative polarity) on the intermediate transfer belt 5 is finally collected into the black toner storage container.

Figure 3D:
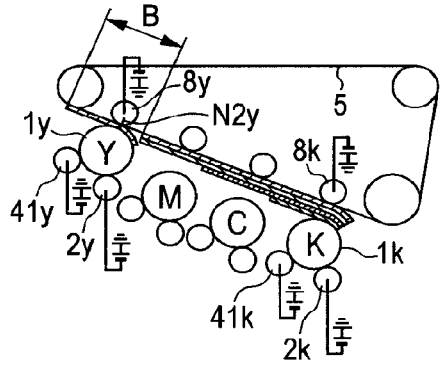

According to this embodiment, as illustrated in FIG. 3D, subsequently, at the moment when a trailing end of the magenta toner (a leading end of a single-color portion of the yellow toner) transferred onto the intermediate transfer belt 5 reaches the yellow primary transfer nip position N2*y*, the yellow photosensitive drum 1*y* and the intermediate transfer belt 5 are brought into contact. At the same time, the negative polarity voltage is applied to the yellow primary transfer roller 8*y*. Consequently, the toner existing in a region α of the intermediate transfer belt 5 is shifted to the yellow photosensitive drum 1*y*. Here, the region α means a region in which the yellow toner is transferred but the magenta toner is not, that is, a region from the contact position N2*y* between the first photosensitive drum 1*y*, which is the first to transfer the toner, and the intermediate transfer belt 5 to the contact position N2*m* between the second photosensitive drum 1*m*, which is the second to transfer the toner, and the intermediate transfer belt 5. Further, the voltage (negative polarity) applied in FIG. 3B is applied to the yellow charging unit 2*y* and the yellow developing roller 41*y*. With this operation, it is possible to selectively shift the yellow single-color toner on the intermediate transfer belt 5 to the yellow photosensitive drum 1*y* and the yellow developing roller 41*y* (FIG. 3D), and to finally collect the toner by the yellow toner storage container 42*y*.

Figure 3E:
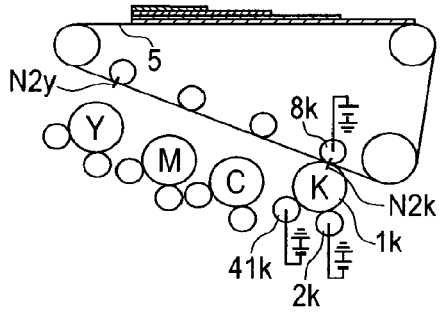

Subsequently, as illustrated in FIG. 3E, after a trailing end of the yellow toner transferred onto the intermediate transfer belt 5 passes the yellow primary transfer nip position N2*y* and before the leading end of the mixed-color toner transferred onto the intermediate transfer belt 5 reaches the yellow primary transfer nip position N2*y* again, the yellow photosensitive drum 1*y* is separated from the intermediate transfer belt 5 again. Further, after the trailing end of the yellow toner transferred onto the intermediate transfer belt 5 passes the black primary transfer nip position N2*k* and before the leading end of the mixed-color toner transferred onto the intermediate transfer belt 5 reaches the black primary transfer nip position N2*k* again, the polarity of the voltage being applied to the black primary transfer roller 8*k* is reversed. In other words, the polarity of the voltage is switched to the positive polarity. (FIG. 3E).

With those operations, the positive polarity mixed-color toner remaining on the intermediate transfer belt 5 is passed the opposite side of the yellow photosensitive drum 1*y* without shifting onto the yellow photosensitive drum 1*y*, then shifted to the black photosensitive drum 1*k* and further to the black developing roller 41*k*, and finally collected into the black toner storage container 42*k*.

Figure 3F:
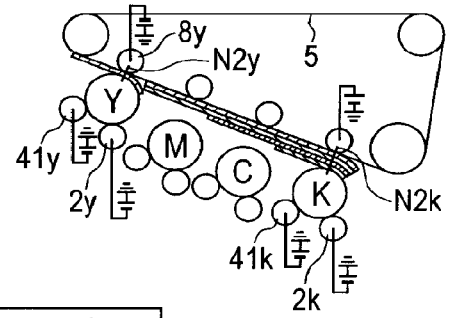
Figure 3F:
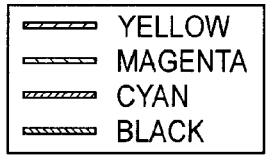

Further, as illustrated in FIG. 3F, at the moment when the trailing end of the magenta toner (the leading end of the single color portion of the yellow toner) transferred onto the intermediate transfer belt 5 reaches the yellow primary transfer nip position N2*y* again, the yellow photosensitive drum 1*y* and the intermediate transfer belt 5 are brought into contact again, and at the same time, the positive polarity voltage is applied to the yellow primary transfer roller 8*y*. In so doing, the voltage (negative polarity) applied in FIG. 3B is applied to the yellow charging unit 2*y* and the yellow developing roller 41*y*. With this operation, it is possible to selectively shift the positive polarity yellow single-color toner adhering onto the intermediate transfer belt 5 to the yellow photosensitive drum 1*y* and further to the yellow developing roller 41*y*, and to finally collect the toner by the yellow toner storage container 42*y*.

With the above-mentioned operations in FIGS. 3C to 3F, regardless of the polarity of the adhering toner, among all the residual toner on the intermediate transfer belt 5, the yellow toner existing in the region α of the intermediate transfer belt 5 is collected into the yellow developing unit 4*y*, which is the first developing unit. On the other hand, it is possible to collect the mixed-color toner existing in a region other than the region α (region β) by the black developing unit 4*k*.

Figure 4:
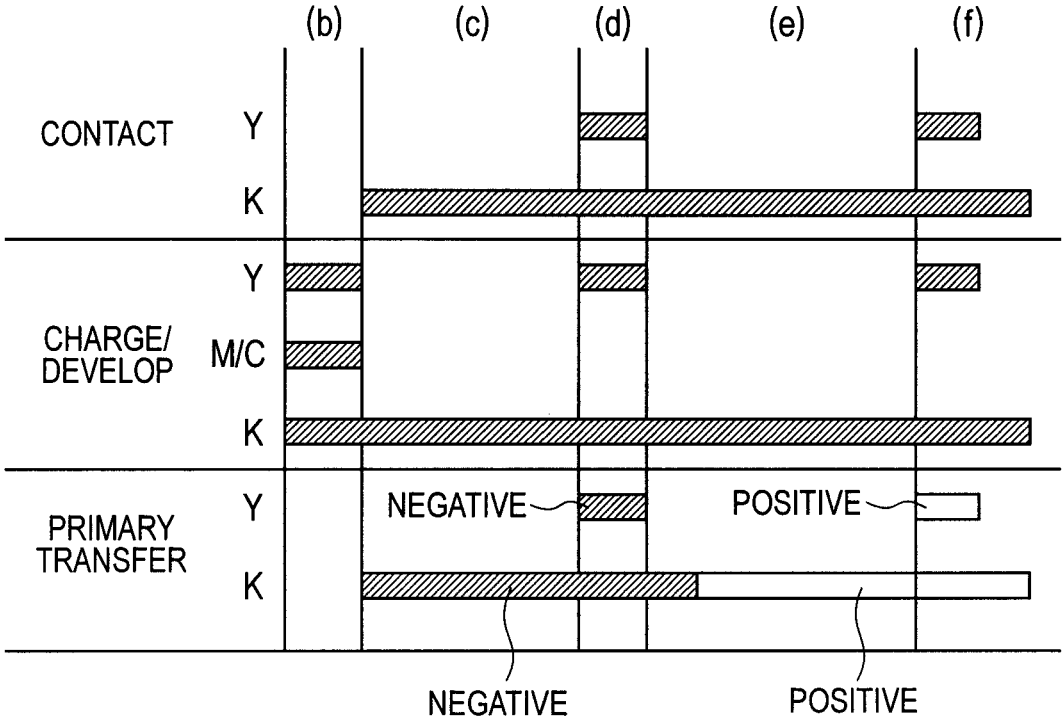
FIG. 4 is a sequence diagram illustrating the second cleaning mode of the color image forming apparatus.

Note that, the above-mentioned series of sequential operations are illustrated in FIG. 4.

In other words, it is possible to reduce other color toners recollected into the black toner storage container 42*k* by carrying out the series of operations, and thus it is possible to prevent the variation in color tone when the toner in the black developing unit 4*k* is reused. Further, as regards to the amount of each color toner in the adhering toner, the yellow toner amount is larger than other color toners because the photosensitive drum 1*y* is located at the most upstream in the belt rotation direction. Therefore, leaving the adhering toner to be entirely collected into the black toner storage container 42*k* is likely to cause the variation in color tone. However, by carrying out the second cleaning mode, it is possible to reduce the yellow toner amount to be collected into the black toner storage container 42*k* and inhibit the variation in black color tone.

When the second cleaning mode is executed, as with the case of the first cleaning mode, in order to facilitate the toner shift, an appropriate circumferential speed difference may be set between the intermediate transfer belt 5 and the photosensitive drums 1 and between the photosensitive drums 1 and the developing rollers 41*k* to move or turn the intermediate transfer belt 5, the photosensitive drums 1, and the developing rollers 41*k*

Although the toner of the most upstream (the first color) developing unit 4 is described as the yellow toner in this embodiment, it is not intended to be restrictive. Any color is applicable as long as it is not black.

Further, in this embodiment, the so-called intermediate-transfer type, four-color inline full color printer has been used as an example, which is provided with the intermediate transfer member which temporarily carries the toner developed on multiple image bearing members and collectively transfers the toner to the transfer material. However, the type of the printer is not limited to this, as long as the effect of the present invention is achieved. For example, the present invention is also applicable to a direct-transfer type, four-color inline full color printer, in which the transfer material is carried and conveyed by the conveying belt and the toner developed on multiple image bearing members are multiply transferred onto the transfer material. In this case, the conveying belt (that is, direct transfer member) may be substituted for the above-mentioned intermediate transfer belt 5, thereby performing the above-mentioned series of operations.

While the present invention has been described with reference to an exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2010-083462, filed Mar. 31, 2010, which is hereby incorporated by reference herein in its entirety.

What is claimed is:

1. An image forming apparatus, comprising:

a plurality of image bearing members on which an electrostatic latent image is formed;

a plurality of developing units which includes toner storage containers respectively containing a different color of toner, and which respectively develops the toner contained in the toner storage container onto each of the plurality of image bearing members; and a belt which is capable of rotating, and which transfers toner images developed on the plurality of image bearing members onto a transfer material, the image forming apparatus being capable of executing a first cleaning mode and a second cleaning mode to move the toner adhering onto the belt from the belt onto the image bearing members and to collect the adhering toner moved onto the image bearing members into the toner storage containers of the developing units, wherein, in the first cleaning mode, the adhering toner is moved onto the image bearing member corresponding to the developing unit developing a black toner and the moved adhering toner is collected into the toner storage container of the developing unit developing the black toner, and in the second cleaning mode, a portion of the adhering toner is moved to the image bearing member that corresponds to the developing unit developing a toner other than the black toner and is located at a most upstream position in a rotation direction of the belt among the plurality of image bearing members, the portion of the adhering toner is collected into the toner storage container of the development unit corresponding to the image bearing member located at the most upstream position, and the rest of the adhering toner is moved to the image bearing member corresponding to the developing unit developing the black toner to collect the rest of the adhering toner into the toner storage container of the developing unit developing the black toner.

2. An image forming apparatus according to claim 1, wherein:

each of the plurality of image bearing members is capable of being brought into contact with and separating from the belt; and when the second cleaning mode is executed, first, all the plurality of image bearing members are separated from the belt and residual toner on each of the plurality of image bearing members is collected into the toner storage container of each of the plurality of developing units.

3. An image forming apparatus according to claim 2, wherein, when the second cleaning mode is executed, the image bearing member corresponding to the developing unit developing the black toner is brought into contact with the belt after the residual toner is entirely collected and before a leading end of the adhering toner passes the image bearing member corresponding to the developing unit developing the black toner.

4. An image forming apparatus according to claim 3, wherein, when the second cleaning mode is executed, the image bearing member located at the most upstream position is brought into contact with the belt after the residual toner is entirely collected and before a trailing end of the adhering toner passes the image bearing member located at the most upstream position.

5. An image forming apparatus according to claim 4, wherein the portion of the adhering toner adheres onto the belt between a position at which the image bearing member located at the most upstream position is brought into contact with the belt and a position at which the image bearing member adjacent to the image bearing member located at the most upstream position brings into contact with the belt, when the second cleaning mode is executed.

6. An image forming apparatus according to claim 1, wherein the belt is an intermediate transfer belt.

7. An image forming apparatus according to claim 1, wherein the belt is a conveying belt which conveys the transfer material.

8. An image forming apparatus according to claim 1, wherein the second cleaning mode is executed in a case of jamming of the transfer material in the image forming apparatus.

9. An image forming apparatus according to claim 1, wherein the second cleaning mode is executed in a misprinting case.

* * * * *